US006566795B2

(12) United States Patent
Ohmae et al.

(10) Patent No.: US 6,566,795 B2
(45) Date of Patent: May 20, 2003

(54) CATHODE RAY TUBE HAVING APERTURED SHADOW MASK

(75) Inventors: Hideharu Ohmae, Osaka (JP); Yoshikazu Demi, Shiga (JP); Nozomu Arimoto, Osaka (JP); Hideaki Etou, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 173 days.

(21) Appl. No.: 09/753,543

(22) Filed: Jan. 2, 2001

(65) Prior Publication Data

US 2001/0008359 A1 Jul. 19, 2001

(30) Foreign Application Priority Data

Jan. 13, 2000 (JP) ..... 2000-004982

(51) Int. Cl.[7] ..... H01J 29/80
(52) U.S. Cl. ..... 313/402; 313/403
(58) Field of Search ..... 313/364, 402, 313/403, 408

(56) References Cited

U.S. PATENT DOCUMENTS

| | | | | |
|---|---|---|---|---|
| 4,926,089 A | | 5/1990 | Moore | 313/403 |
| 5,280,215 A | * | 1/1994 | Ohtake et al. | 313/403 |
| 5,583,391 A | | 12/1996 | Moore | 313/402 |
| 5,631,520 A | * | 5/1997 | Inoue et al. | 313/402 |
| 5,856,725 A | | 1/1999 | Ueda | 313/402 |
| 6,124,668 A | | 9/2000 | Shoda | 313/403 |

FOREIGN PATENT DOCUMENTS

| | | |
|---|---|---|
| EP | 0 487 106 | 5/1992 |
| FR | 2 801 136 | 5/2001 |
| GB | 2 351 600 | 1/2001 |
| JP | 63-119139 | 5/1988 |
| JP | 1-320738 | 11/1989 |
| JP | 1-320738 | 12/1989 |
| JP | 9-265916 | 10/1997 |

OTHER PUBLICATIONS

Dec. 21, 2001 EPO Search Report

* cited by examiner

*Primary Examiner*—Hoan Tran
(74) *Attorney, Agent, or Firm*—Merchant & Gould P.C.

(57) ABSTRACT

A cathode ray tube capable of reducing the doming amount and suppressing the occurrence of moire stripes at the same time, which also can prevent the so-called persimmon stone phenomenon from occurring, is provided. In the apertures, the protruding portions that are protruding from end faces in the horizontal direction of the apertures to the inside of the apertures are formed. The protruding portion in the aperture located on the right side of the phosphor surface from the vertical center line of the shadow mask is protruding in the direction toward the peripheral portion on the right side, while the protruding portion in the aperture located on the left side of the phosphor surface is protruding toward the peripheral portion on the left side. Accordingly, the doming amount can be reduced and the occurrence of moire stripes can be suppressed at the same time, while the persimmon stone phenomenon in which the beam spot of an electron beam on the phosphor surface is cut partially can be prevented from occurring.

5 Claims, 7 Drawing Sheets

PRIOR ART

PRIOR ART

CATHODE RAY TUBE HAVING APERTURED SHADOW MASK

FIELD OF THE INVENTION

The present invention relates to a shadow mask type cathode ray tube, which is used for a television receiver, a computer display, and the like.

BACKGROUND OF THE INVENTION

FIG. 4 is a cross-sectional view showing one example of a conventional color cathode ray tube. The color cathode ray tube 1 shown in FIG. 4 includes a substantially rectangular-shaped face panel 2 having a phosphor screen 2*a* on its inner face, a funnel 3 connected to the rear side of the face panel 2, an electron gun 4 contained in a neck portion 3*a* of the funnel 3, a shadow mask 6 facing the phosphor screen 2*a* inside the face panel 2, and a mask frame 7 for fixing the shadow mask 6. Furthermore, in order to deflect and scan electron beams, a deflection yoke 5 is provided on the outer periphery of the funnel 3.

The shadow mask 6 plays a role of selecting colors with respect to three electron beams emitted from the electron gun 4. "A" shows a track of the electron beams. The shadow mask is provided with a number of apertures formed by etching, through which electron beams pass.

In a color cathode ray tube, due to the thermal expansion caused by the impact of the emitted electron beams, the electron beam through aperture is shifted. Consequently, a doming phenomenon occurs. That is, the electron beams passing through the apertures fail to hit a predetermined phosphor correctly, thus causing unevenness in colors. Therefore, a tension force to absorb the thermal expansion due to the temperature increase of the shadow mask is applied in advance, and then the shadow mask is stretched and held to the mask frame. When the shadow mask is stretched and held as mentioned above, even if the temperature of the shadow mask is raised, it is possible to reduce the amount of displacement between an aperture of the shadow mask and phosphor strips of the phosphor screen.

FIG. 5 is a plan view showing an example of a shadow mask 35 to which a tension force is applied mainly in the vertical direction (vertical direction of the screen). Apertures 36 are formed at constant pitches. Reference numeral 37 is referred to as a bridge, which is a portion between respective apertures 36. The bridge width has an effect on the mechanical strength of the shadow mask. More specifically, the bridge with a narrow width has a weak tension force particularly in the horizontal direction. If the bridge width is increased in order to improve the mechanical strength, the open area of the aperture is reduced, thus deteriorating the luminance intensity.

Furthermore, the vertical pitch of the bridge is related to the doming amount of the shadow mask. The shadow mask is stretched mainly in the vertical direction. Therefore, the thermal expansion in the vertical direction is absorbed by the tension force, while the thermal expansion in the horizontal direction is transmitted in the horizontal direction through the bridges. The doming amount can be reduced by increasing the vertical pitch of the bridge. Therefore, when the vertical pitch of the bridge is increased, the doming amount can be reduced. In this case, however, moire stripes easily occur, thus causing the deterioration of the image quality. The moire stripe means a mutual interference stripe between scanning lines (luminescent lines) of the electron beams arranged at constant intervals and the regular pattern of the electron beam through apertures of the shadow mask.

Furthermore, when the vertical pitch of the bridge is increased, the bridges themselves may appear as dots on the screen, or may be recognized as a pattern in which the bridges are piled up (a brick-like pattern).

On the contrary, when the vertical pitch of the bridge is reduced, moire stripes are suppressed sufficiently and the bridges themselves are not noticeable, but the doming amount is increased.

To solve this problem, as shown in FIG. 6A, for example, a shadow mask 40 is proposed in which protruding portions 42*a*, 42*b* protruding in different directions are formed in an aperture 41. By forming the protruding portions 42*a*, 42*b*, the vertical pitch of the bridge is maintained at a large value, while the occurrence of moire stripes can be suppressed in the same manner as the vertical pitch of the bridge is reduced. In other words, it is possible to reduce the doming amount of the shadow mask to which a tension force is applied mainly in the vertical direction and also to suppress the occurrence of moire stripes at the same time.

Furthermore, a shadow mask provided with slot-shaped apertures shows a so-called "persimmon stone phenomenon", which is characterized as follows. By taking the vertical center line of the shadow mask as the border, electron beams entering obliquely into apertures located on the right side of the phosphor screen 2*a* (FIG. 4) are cut in the vicinity of upper right and lower right corners of the apertures, and electron beams entering obliquely into apertures located on the left side are cut in the vicinity of upper left and lower left corners of the apertures.

FIG. 7A is a horizontal cross-sectional view showing the vicinity of upper and lower corners of an aperture located on the right side of the phosphor screen by taking the vertical center line of the shadow mask as the border. FIG. 7A shows a state in which a portion of an electron beam ray 51 passing through an aperture 50 is cut by an ascending portion 52 of the aperture 50. In this way, when the electron beam is cut in the vicinity of the upper right and lower right corners of the aperture, as illustrated in FIG. 7B, the shape of a beam spot 53 that originally is intended to be of a substantially slot shape is formed into the shape of a persimmon stone. Shaded portions 54*a* and 54*b* are portions where the electron beam ray was cut.

In order to prevent this persimmon stone phenomenon in the vicinity of the upper and lower corners of the apertures, various shapes of apertures are proposed. For example, JP1(1989)-320738A discloses a method for preventing this persimmon stone phenomenon by increasing a width of an open portion (i.e. W in FIG. 7A) in the vicinity of upper right and lower right corners of apertures located on the right side of a shadow mask from the vertical center line. Furthermore, JP63(1988)-119139A discloses another method for preventing electron beams from being cut, as shown in FIG. 7C, by widening upper and lower end portions a, b of an aperture 55.

Although the shadow mask 40 shown in FIG. 6A can suppress the occurrence of moire stripes with the protruding portions 42*a*, 42*b* by shielding the electron beam in the same manner as the vertical pitch of the bridge is reduced, this shadow mask still suffered from this persimmon stone phenomenon. In other words, as illustrated in FIG. 6B, the electron beam is cut in base portions C with regard to the aperture 41 located on the right side of the shadow mask from the vertical center line, and the electron beam is cut in base portions D with regard to the aperture 41 located on the left side from the vertical center line of the shadow mask.

Furthermore, the apertures proposed by JP1(1989)-320738A and JP63(1988)-119139A both try to prevent this persimmon stone phenomenon by changing the aperture shape, but there is a limitation to solve the above problem with the shape.

SUMMARY OF THE INVENTION

It is an object of the present invention to solve the conventional problems described above by providing a cathode ray tube capable of reducing the doming amount and suppressing the occurrence of moire stripes at the same time, and which can prevent the so-called persimmon stone phenomenon from occurring.

To achieve the above object, a cathode ray tube of the present invention includes a shadow mask made of a flat plate provided with a number of apertures, wherein protruding portions protruding in the horizontal direction from an end of the aperture that is closer to the vertical center line of the shadow mask are formed at least in the apertures positioned in the vicinity of both right and left edges of the shadow mask. According to the configuration described above, while the cathode ray tube can reduce the doming amount and suppress the occurrence of moire stripes at the same time, the persimmon stone phenomenon in which the beam spot of an electron beam on the phosphor surface is cut partially can be prevented from occurring.

In the cathode ray tube described above, it is preferable that an end of the aperture that is farther from the vertical center line has dented portions in areas opposing tips of the protruding portions. According to this configuration, the dented portions are formed so that the protruding portions can be lengthened and the area of the aperture can be enlarged at the same time. Thus, the occurrence of moire stripes and the persimmon stone phenomenon can be suppressed even more surely.

Furthermore, it is preferable that the protruding portions are formed almost on the entire shadow mask.

Furthermore, it is preferable that the shadow mask is stretched and held in a state in which a tension force is applied in the vertical direction.

Furthermore, it is preferable that the shadow mask is formed into a curved shape.

DETAILED DESCRIPTION OF THE INVENTION

Figure 4:
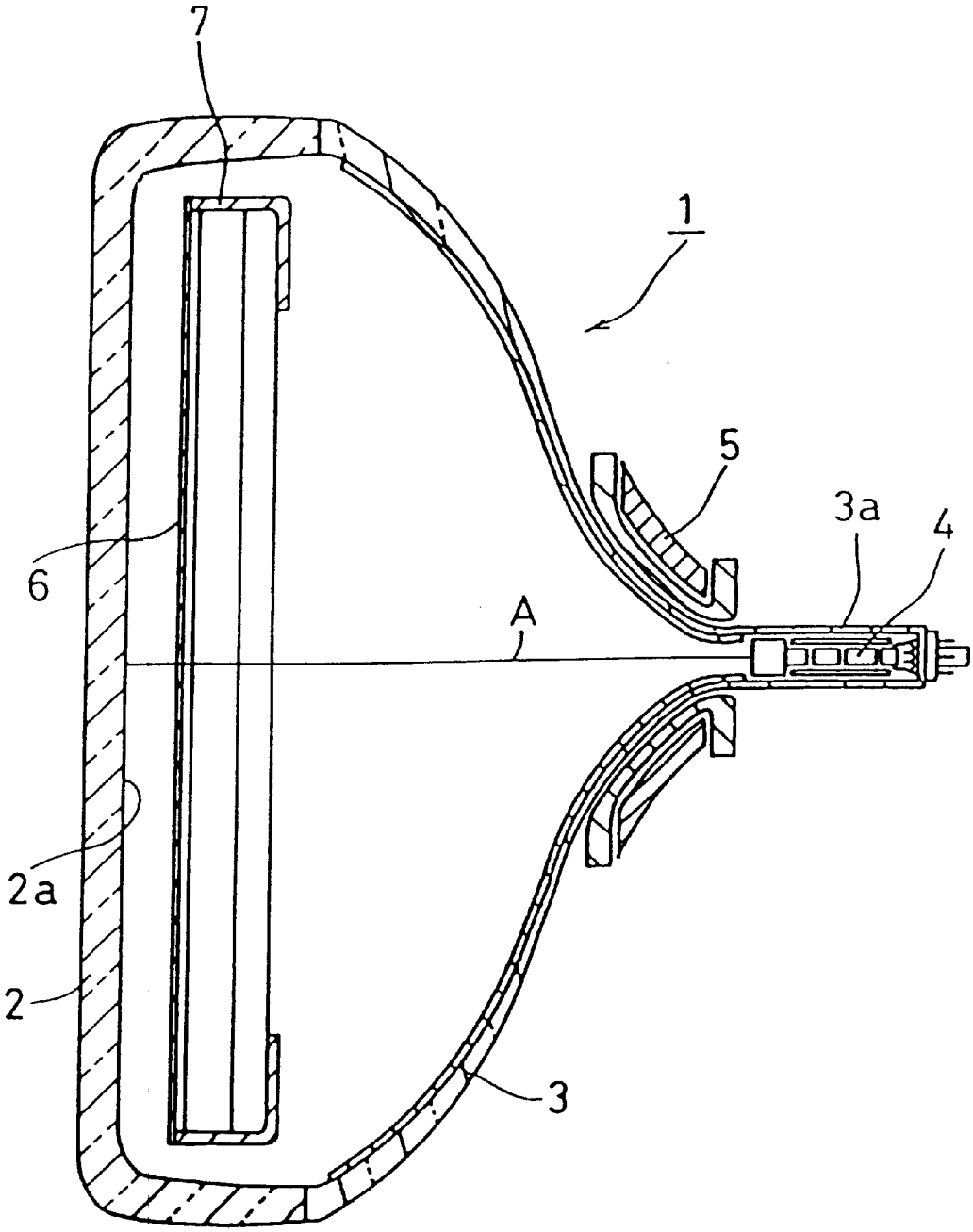
FIG. 4 PRIOR ART
FIG. 4 is a cross-sectional view showing an example of a color cathode ray tube.
Figure 5:
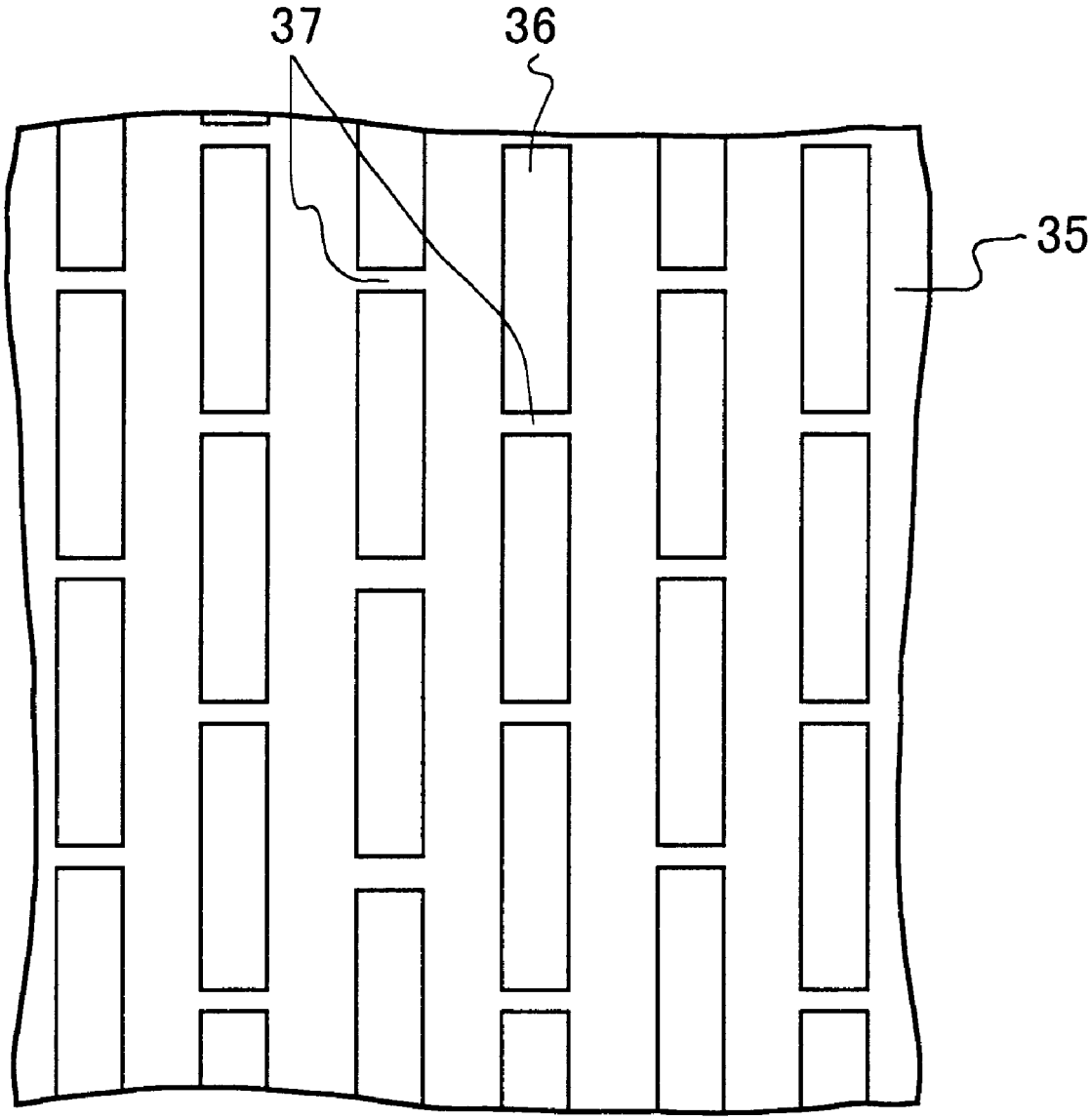
FIG. 5 PRIOR ART
FIG. 5 is a plan view showing an example of a conventional shadow mask.

Hereinafter, the present invention will be described by way of an embodiment with reference to drawings. Since the construction of the color cathode ray tube described with reference to FIG. 4 is the same as that in this embodiment, the explanations thereof are not repeated herein.

Figure 1:
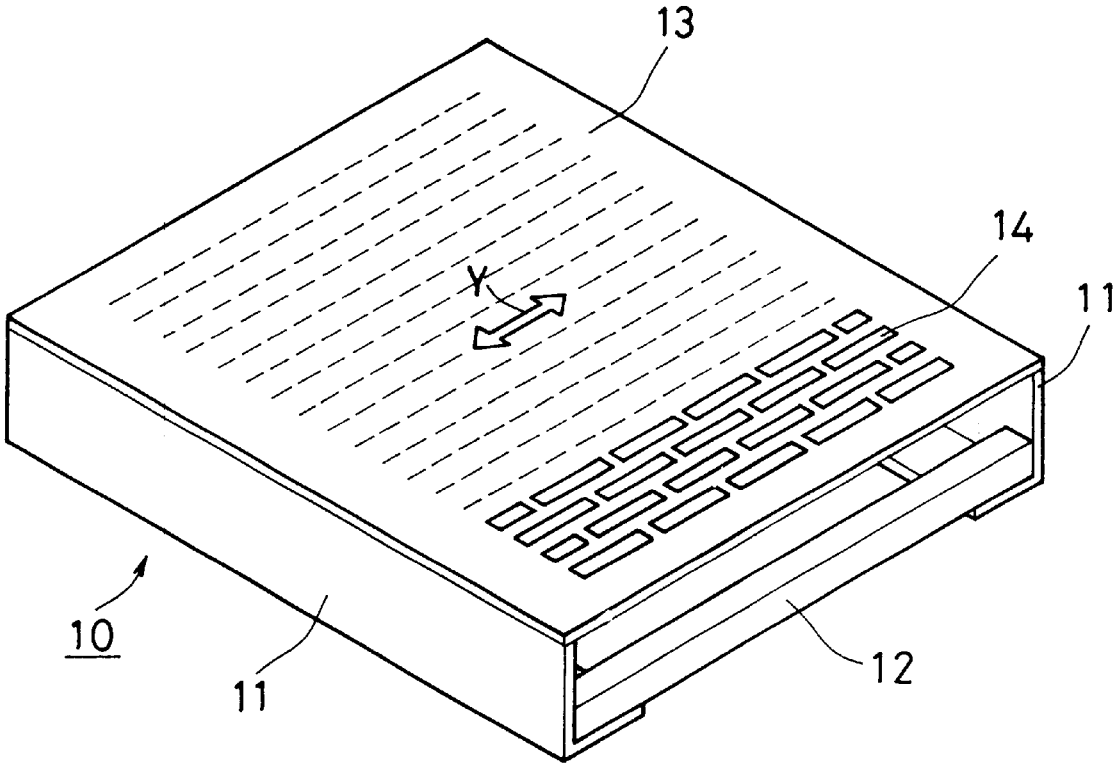
FIG. 1 is a perspective view showing a color-selecting electrode of one embodiment of to the present invention.

FIG. 1 is a perspective view showing a color-selecting electrode of one embodiment. A mask frame 10 is a rectangular frame and is made of a pair of long frame supports 11, facing each other, fixed to a pair of short frames made of elastic members 12. On the shadow mask 13, apertures 14, through which electron beams pass, are formed by etching.

In this drawing, a tension method is employed, and the shadow mask 13 is stretched and held between the supports 11 with a tension force applied mainly in the direction illustrated by arrow Y. The aperture 14 is provided with protruding portions 23, 24 to be explained later in FIG. 2A, which are not shown in this drawing.

Figure 2A:
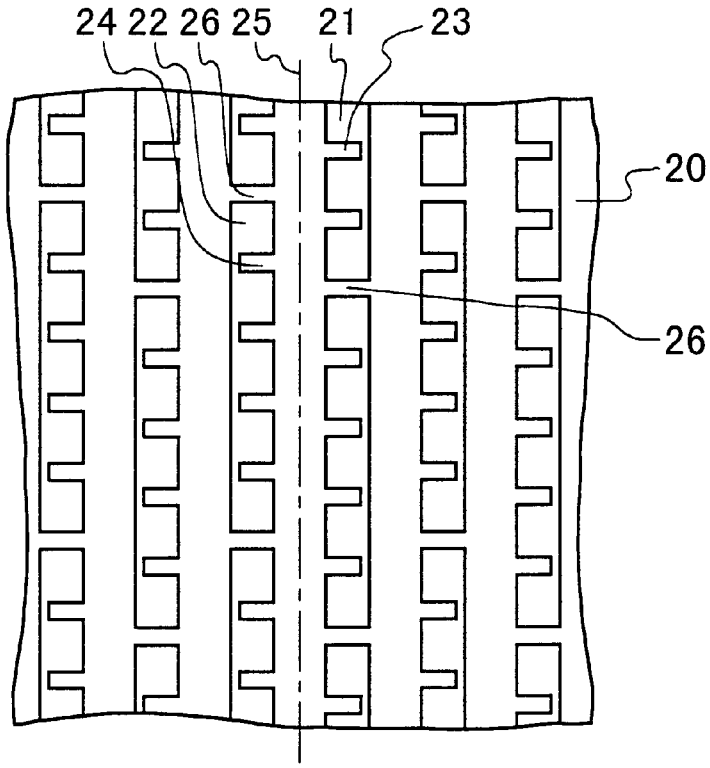
FIG. 2A is a plan view showing a shadow mask of one embodiment of the present invention.
Figure 2B:
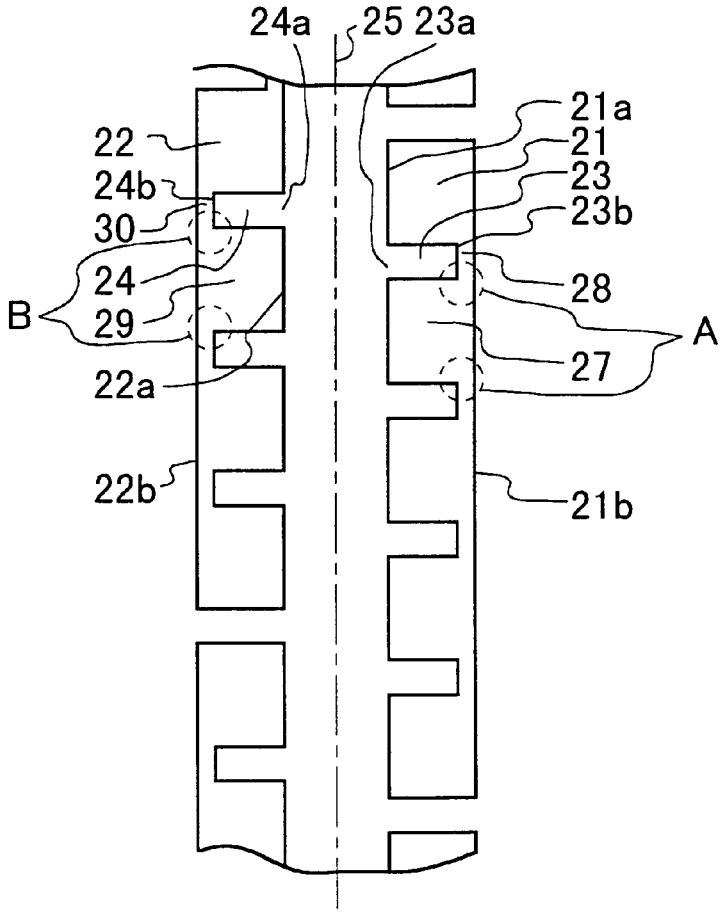
FIG. 2B is an enlarged view of FIG. 2A.

FIG. 2A is a plan view showing one embodiment of a shadow mask. FIG. 2B is an enlarged view of one portion in FIG. 2A. In the shadow mask 20 shown in FIG. 2, the vertical direction of the drawing is the vertical direction of the screen, and the horizontal direction is the horizontal direction of the screen. A vertical center line 25 shows the vertical center line of the shadow mask 20. By taking the vertical center line 25 as the border, the protruding portion 23 is formed in an aperture 21 arranged in an area on the right side of the phosphor screen surface 2*a* (FIG. 4) (hereinafter referred to as "the right area"), while the protruding portion 24 is formed in an aperture 22 arranged in an area on the left side of the phosphor screen surface 2*a* (hereinafter referred to as "the left area"). The apertures 21, 22 neighboring in the vertical direction are linked by a bridge 26.

The protruding portions 23, 24 respectively are protruding from one end of the horizontal direction of the apertures 21, 22. Both the protruding portions 23 and 24 are protruding in the horizontal directions away from the vertical center line 25 in the apertures 21, 22, that is, in the directions toward the right and left peripheries of the shadow mask. More specifically, a base 23*a* of the protruding portion 23 in the right area is formed along an end face 21*a* that is closer to the vertical center line 25 of the aperture 21. A first opening 27 is formed between the protruding portions 23 neighboring in the vertical direction, and a second opening 28 is formed between a tip 23*b* of the protruding portion 23 and an end face 21*b* of the aperture 21.

In the left area, the protruding portion 24 is protruding in the opposite direction, and a base 24*a* of the protruding portion 24 in the left area is formed along an end face 22*a* that is closer to the vertical center line 25 of the aperture 22. A first opening 29 is formed between the protruding portions 24 neighboring in the vertical direction, and a second opening 30 is formed between a tip 24*b* of the protruding portion 24 and an end face 22*b* of the aperture 22.

By forming such protruding portions 23, 24, electron beams can be shielded, so that the same effect can be obtained as the vertical pitch of the bridge 26 being reduced, and the occurrence of moire stripes can be suppressed. In addition, the protruding portions 23, 24 do not cover up the apertures 21, 22 completely in the horizontal direction. The tips 23*b*, 24*b* and the end faces 21*b*, 22*b* are separated because the second openings 28, 30 are formed. Therefore, the thermal expansion in the horizontal direction is not transmitted between the tips 23*b*, 24*b* and the end faces 21*b*, 22*b*, and the doming can be prevented. In other words, according to this embodiment, it is possible to reduce the doming amount of the shadow mask to which a tension force is applied mainly in the vertical direction and also to suppress the occurrence of moire stripes at the same time.

Furthermore, the first opening 27 is formed in a plurality in one aperture 21 in the right area, and each of the first opening 27 functions as one aperture. In other words, it is equivalent to the state in which a plurality of apertures whose vertical pitch is reduced is formed in one aperture 21.

Figure 6A:
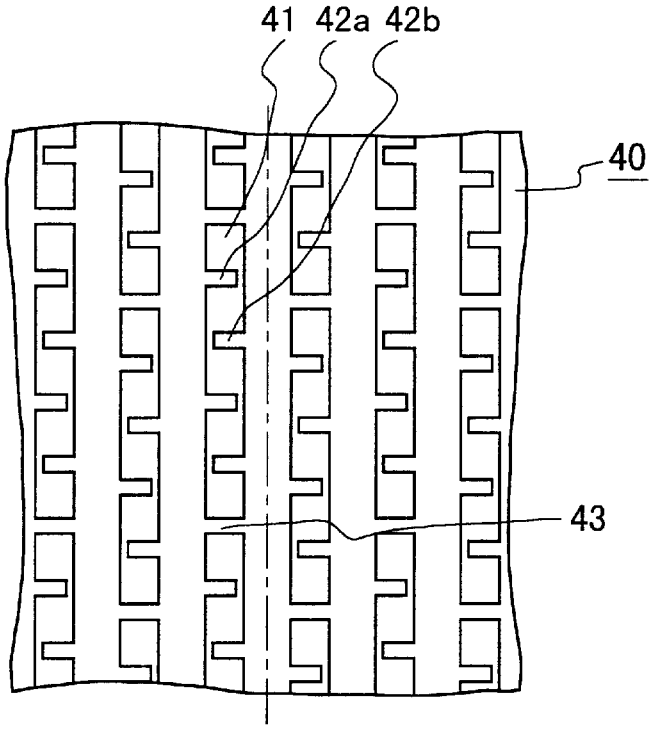
FIG. 6A is a plan view showing another example of a conventional shadow mask.
Figure 6B:
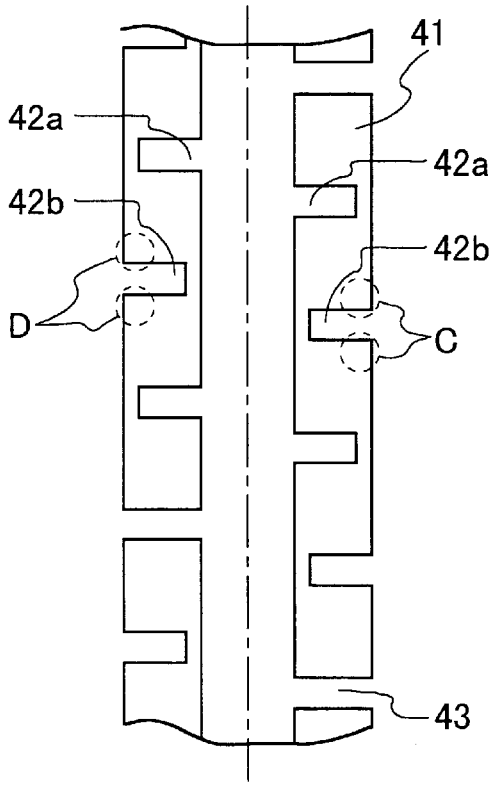
FIG. 6B is an enlarged view of FIG. 6A.
Figure 7A:
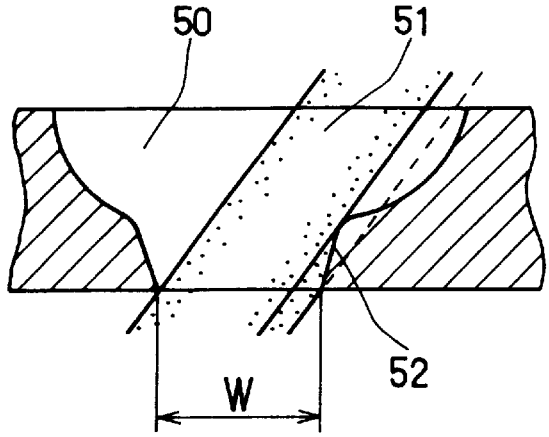
FIG. 7A is a horizontal cross-sectional view showing upper and lower areas of an aperture in a conventional shadow mask.
Figure 7B:
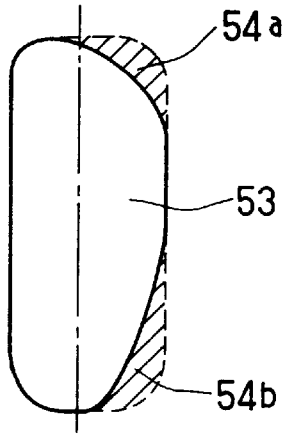
FIG. 7B is a plan view showing an example of a conventional beam spot shape.
Figure 7C:
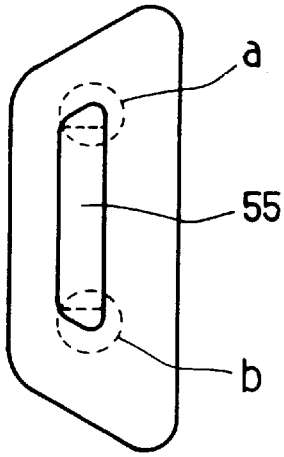
FIG. 7C is a plan view showing an example of a conventional aperture shape.

In this embodiment, the second openings 28 respectively are formed in the upper right portion and in the lower right portion of the first opening 27. Therefore, the corner portions C as illustrated in FIG. 6B are not formed along the end face 21*b* on the right side of the aperture 21 in this drawing.

In other words, the aperture is enlarged in the vicinity of the upper right and lower right corners of the first opening 27 by the second openings 28, which is equivalent to the state in which a plurality of apertures having enlarged upper right and lower right corners are formed in one aperture 21.

Thus, electron beams can be prevented from being cut in area portions A of the first opening 27, and the so-called persimmon stone phenomenon in which the beam spot of an electron beam on the phosphor surface is cut partially can be prevented from occurring.

This means that the left area also has the same configuration except that the left-right relationship is now opposite. Accordingly, the first opening 29 is formed in a plurality in one aperture 22, and the second openings 30 are formed in the upper left portion and in the lower left portion of the first opening 29. Therefore, the corner portions D as illustrated in FIG. 6B are not formed along the end face 22*b* on the left side of the aperture 22 in this drawing. As a result, electron beams can be prevented from being cut in area portions B of the first opening 29, and the persimmon stone phenomenon can be prevented from occurring.

According to this embodiment, while the doming amount and the occurrence of moire stripes of the shadow mask can be suppressed at the same time, the persimmon stone phenomenon can be prevented from occurring in which the beam spot of an electron beam on the phosphor surface is cut in the upper and lower corners of one side.

Here, the persimmon stone phenomenon described above is likely to occur in the peripheral portions or in the corners of the shadow mask on the right and left sides where the incident angle of the electron beam is enlarged. Therefore, when the apertures provided with the protruding portions arranged in the manner described above are formed at least in the vicinity of both right and left edges, the effect of preventing the electron beams from being cut can be obtained.

Further, since the incident angle of the electron beam is enlarged also in the vicinity of both upper and lower edges of the shadow mask, it is preferable that the apertures provided with the protruding portions are formed at least in the vicinity of both the right and left edges and both the upper and lower edges of the shadow mask.

Specifically, it is preferable that the apertures with the protruding portions are formed at least in the areas whose lengths in the horizontal direction measured from both the right and left edges of the perforated area of the shadow mask are approximately one third the total length of the perforated area in the horizontal direction, respectively, and in the areas whose lengths in the vertical direction measured from both the upper and lower edges of the perforated area are approximately one tenth the total length of the perforated area in the vertical direction, respectively.

Figure 3:
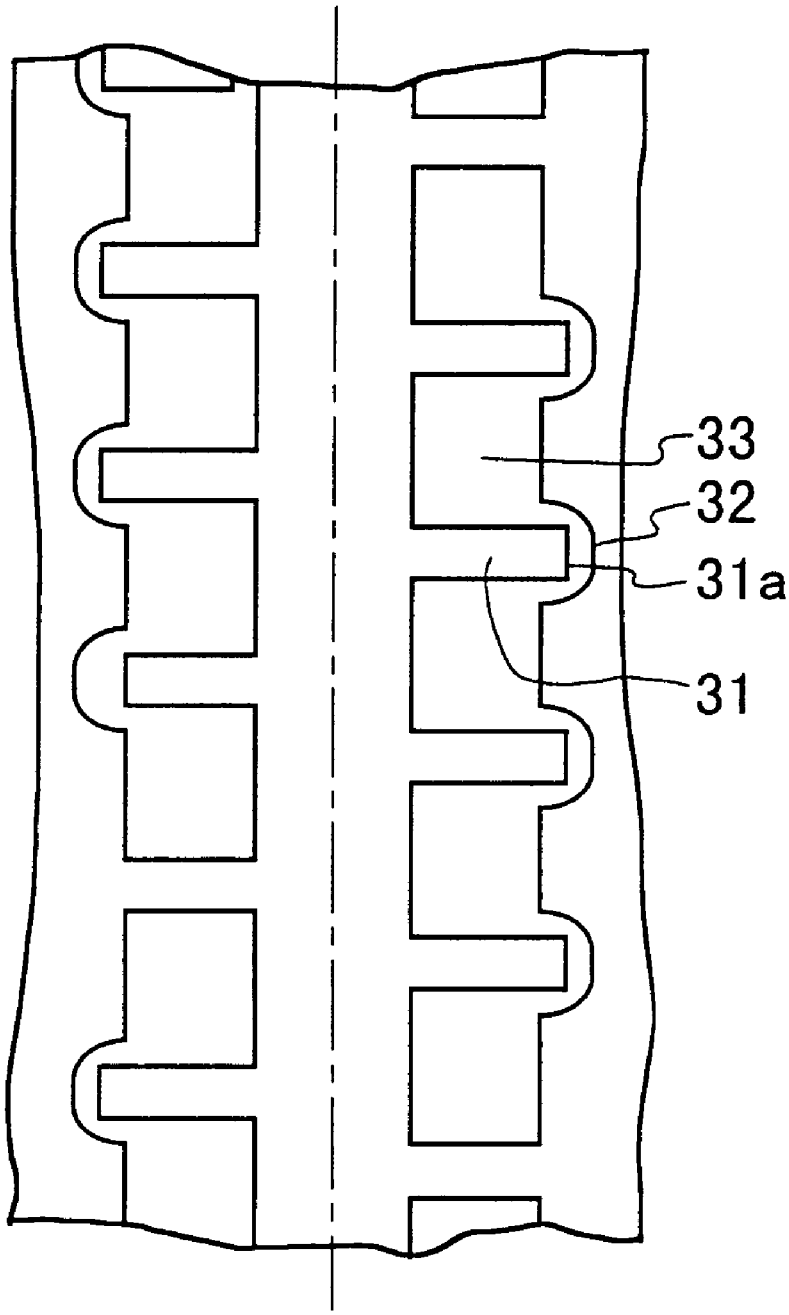
FIG. 3 is an enlarged view of a shadow mask in another embodiment according to the present invention.

FIG. 3 is an enlarged view of a shadow mask in another embodiment. In this embodiment, a dented portion 32 is formed in an aperture 33, so that a tip 31*a* of a protruding portion 31 can be lengthened to surely shield the electron beam in the width of the phosphor with the protruding portion 31. Here, it is not appropriate simply to lengthen the protruding portion without providing the dented portion, because if so, the distance between the tip of the protruding portion and the end face of the aperture is reduced further, which then is difficult to manufacture. In the present embodiment, the dented portion 32 is formed, so that the distance between the tip of the protruding portion and the end face of the aperture can be secured while the protruding portion can be lengthened at the same time. This configuration does not cause any particular manufacturing problems.

Furthermore, in the area where the dented portion 32 is formed, the width of the aperture 33 is wider than in other portions. Therefore, even if electron beams are cut in areas where the horizontal cross section of the aperture 33 has an ascending form, the luminous intensity is not reduced. As a result, the occurrence of moire stripes and the persimmon stone phenomenon can be suppressed even more surely.

The above embodiment was described on the assumption that the shadow mask is stretched and held. However, even if the shadow mask is not stretched and held, the same effect can be obtained with regard to the prevention of electron beams from being cut as described above. Therefore, the present embodiment also is effective for a shadow mask that has a curved surface formed by press molding, which is not stretched and held.

Furthermore, the shape of the protruding portion in the planar direction was illustrated as a rectangular shape in this example, but it is not limited thereto. It is also possible to form the aperture and the protruding portion to have round corners. Alternatively, the protruding portion may be formed so as to protrude gradually from the base to the tip. This kind of gradually protruding shape can be formed easily by the etching method used mainly for the production of shadow masks, so that it is practical.

According to the cathode ray tube of the present invention described above, the protruding portions protruding to the inside of the aperture are formed in the shadow mask, and the protruding portions are protruding in the horizontal directions away from the vertical center line of the shadow mask. As a result, the doming amount can be reduced and the occurrence of moire stripes can be suppressed at the same time. In addition, the persimmon stone phenomenon in which the beam spot of an electron beam on the phosphor surface is cut partially can be prevented from occurring.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube comprising a shadow mask made of a flat plate provided with a number of apertures, wherein protruding portions protruding in the horizontal direction from an end of the aperture that is close to the vertical center line of the shadow mask are formed at least in the apertures positioned in the vicinity of both right and left edges of the show mask, and adjacent protruding portions protrude in a same direction and the aperture does not include a protruding portion at an end of the aperture that opposes a tip of each of the protruding portions.

2. The cathode ray tube according to claim 1, wherein an end of the aperture that is farther from the vertical center line has dented portions in areas opposing tips of the protruding portions.

3. The cathode ray tube according to claim 1, wherein the protruding portions are formed substantially on the entire shadow mask.

4. The cathode ray tube according to claim 1, wherein the shadow mask is stretched and held in a state in which a tension force is applied in the vertical direction.

5. The cathode ray tube according to claim 1, wherein the shadow mask is formed into a curved shape.

* * * * *